United States Patent [19]

Shaud

[11] Patent Number: 4,691,954

[45] Date of Patent: Sep. 8, 1987

[54] SNOW SHOVEL

[76] Inventor: Ronald J. Shaud, 722 Madison Ave., Reading, Pa. 19610

[21] Appl. No.: 896,975

[22] Filed: Aug. 15, 1986

[51] Int. Cl.[4] ..... B25G 1/04; E01H 5/02

[52] U.S. Cl. ..... 294/54.5; 294/57

[58] Field of Search ..... 294/19.1, 49–51, 294/54.5, 57–59; 15/144 B; 16/110 R, 111 R, 111 A, 114 R, 115; 81/177.2; 37/265, 278, 284, 285; 172/705; 173/139, 162 R, 162 H; 267/71, 136, 137, 174; 403/229

[56] References Cited

U.S. PATENT DOCUMENTS

| | | | |
|---|---|---|---|
| 2,085,382 | 6/1937 | Nebor | 294/54.5 |
| 2,536,607 | 1/1951 | Jenkins | 15/144 B X |
| 2,572,230 | 10/1951 | Williams | 294/57 X |
| 2,793,902 | 5/1957 | Govan | 294/57 |
| 3,153,252 | 10/1964 | Ricciardi | 16/115 X |
| 4,070,932 | 1/1978 | Jeannotte | 16/115 X |
| 4,470,440 | 9/1984 | Thor | 173/139 X |
| 4,615,553 | 10/1986 | Hultine | 294/58 |

FOREIGN PATENT DOCUMENTS

| | | | |
|---|---|---|---|
| 2334475 | 8/1977 | France | 16/115 |
| 561688 | 5/1944 | United Kingdom | 294/57 |
| 1423159 | 1/1976 | United Kingdom | 294/57 |
| 2069914 | 9/1981 | United Kingdom | 294/57 |

*Primary Examiner*—Johnny D. Cherry

*Attorney, Agent, or Firm*—Leonard M. Quittner

[57] ABSTRACT

An improved snow shovel is disclosed which has a telescoping handle and a detachable blade. Inside the handle is a compression spring which compresses under load or shock from striking an object submerged in the snow and when the shovel is lifted, the spring decompresses and assists in discharging the load.

2 Claims, 5 Drawing Figures

SNOW SHOVEL

CROSS-REFERENCE

There are no cross-references to, nor are there any related applications.

FEDERALLY-SPONSORED RIGHTS

The invention herein was made without any Federal sponsorship or contribution.

BACKGROUND OF THE INVENTION

1. The Field of the Invention.

The field of the invention relates to an improved snow shovel which has a two (2) part handle with a spring means to absorb shock and to assist in discharging a load of snow.

2. Description of the Prior Art.

The prior art is best demonstrated by U.S. Pat. Nos. 4,550,943 to Mirto, 4,559,726 to Moisan; 3,3310,891 to Sachaczenski, 1,524,639 to Grady, 990,898 to Orcutt and 184,690 to Baker.

'943 teaches a telescopic handle but simply for storage. The telescopic action cooperates with no mechanism. '726, '690 and '639 deal with the reversibility and angular adjustment of the blade to allow for pushing or pulling action and appear to be progeny in the art of '690. Removability of the blade is demonstrated in '898.

'891 discloses a complex mechanism for removing snow which neither absorbs shock nor cooperates with the snow load to compress the spring mechanism which must be done in '891 by foot action on a latch and the load then positively released.

Your inventor has also inspected the pogo stick art of class 272/57 as shown in U.S. Pat. No. 2,871,016 to Rapaport and 2,712,443 to Hohberger to see if anything is taught therein which could be read of interest on the present invention. In each instance and in this art generally no guide against rotation of the inner telescoping member is taught. As a matter of operating principals, such an inhibition is undesirable in the pogo stick art which clearly teaches away therefrom.

SUMMARY OF THE INVENTION

The invention described herein is summarized as a snow shovel whose handle is made in two (2) parts one telescoping inside the other against a concealed compression spring. The spring serves to absorb shock when the blade strikes an object such as the raised lip of a side walk section concealed under the snow and further the spring will come under load from pushing the shovel blade against snow itself and will tend to discharge the snow from the blade directionally when lifted, thereby reducing significantly the use of arms by the shoveler.

An object of the invention is to reduce significantly shock to the body of the shoveler, a common occurrence when a concealed object is stuck.

A further object of the invention is to eliminate or reduce shovel handle breakage thereby extending its life without significantly increasing the weight of the handle.

An additional object is to reduce health hazards associated with snow shoveling by reducing arm movement as the shovel is self-discharging of its load from the expansion of the spring.

Yet another object is to provide a shovel with a detachable blade to facilitate storage as in the trunk of a car.

Other objects, advantages and features of the present invention will be apparent to those skilled in art from the following description taken in conjunction with the accompanying drawings.

DESCRIPTION OF DRAWINGS

The present invention may be better understood by reference to the drawings wherein five (5) figures are shown on two (2) sheets. The numbers shown on the drawings for the various parts of the invention are consistent throughout so that a number indicating a part in one drawing will indicate the same part in another drawing.

DESCRIPTION OF THE PREFERRED EMBODIMENT

Figure 1:
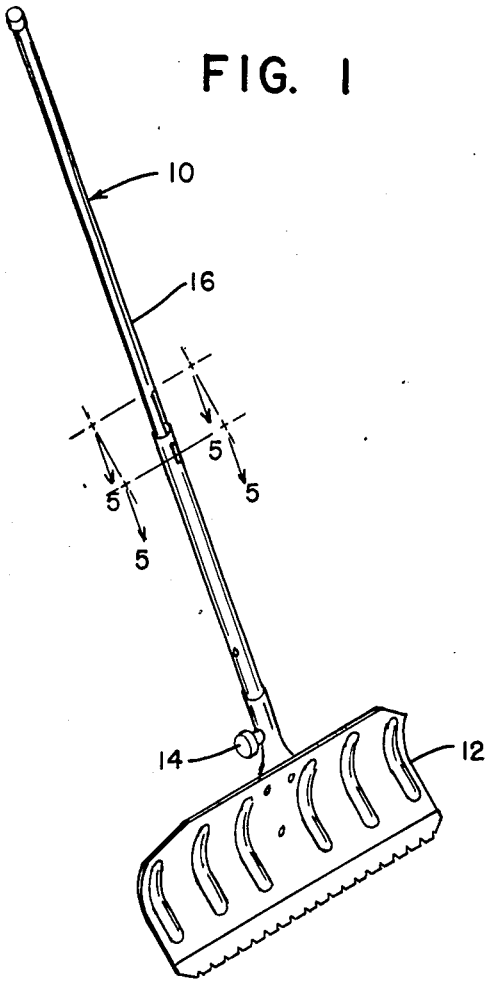
FIG. 1 shows a perspective view of the fully assembled snow shovel.

The preferred embodiment is described as consisting of an improved snow shovel (10) comprising a detachable snow shovel blade (12), a means (14) to attach the blade to a bi-partile telescopic, tubular handle assembly (16) of circular cross-section comprising an upper part (18) with a lower insertable end portion (19) whose upper end portion (20) receives an end cap (22) and a lower, outer part (24) which is attached to the blade. The upper part's insertable end portion receives within its inner diameter an upper end of a compression spring (26) of defined length and of circular cross-section typically made of mild, 16 gauge spring steel, 15 pitches to the foot approximately rated at typically 10 pounds. The upper end of the spring is secured (28) to the lower portion of the upper handle part by through bolt means (30). Attached to the lower end of the spring is a stop bushing (32) which, when the spring is inserted into the outer handle part, is attached thereto by through bolt means (34) such that the spring is fully expanded when the handle is assembled.

Figure 5:
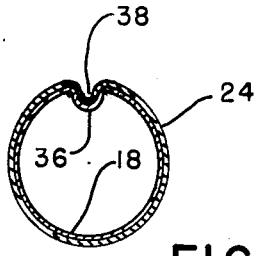
FIG. 5 shows a cross-section of the tubular members at line 5 on FIG. 1.
Figure 4:
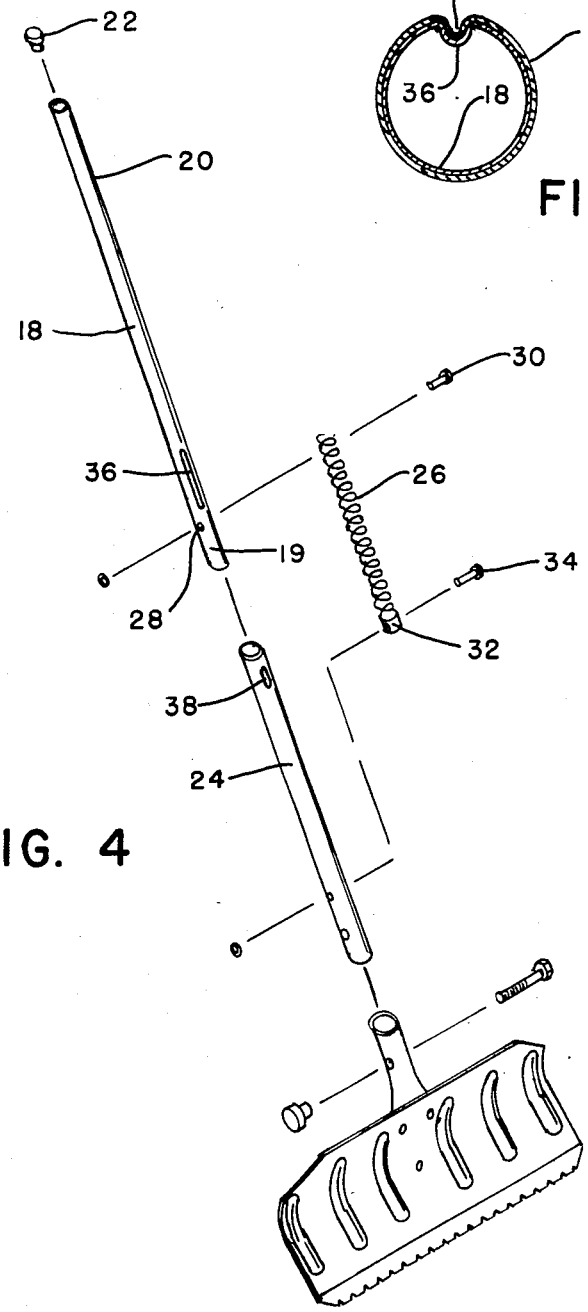
FIG. 4 shows an exploded view of the shovel as it would be assembled.

The upper handle part has stamped or coined along its longitudinal axis and into its inserted end portion a groove (36) of defined length (X) which acts as a guide for and receives and mates with an inwardly directed boss (38) of similar configuration (FIG. 5) which is stamped or coined in the upper end of the lower handle part such that the boss will slide longitudinally in the groove but will prevent the lower tube member from rotating relative to the upper member when the handle parts are assembled (FIG. 1).

Figure 2:
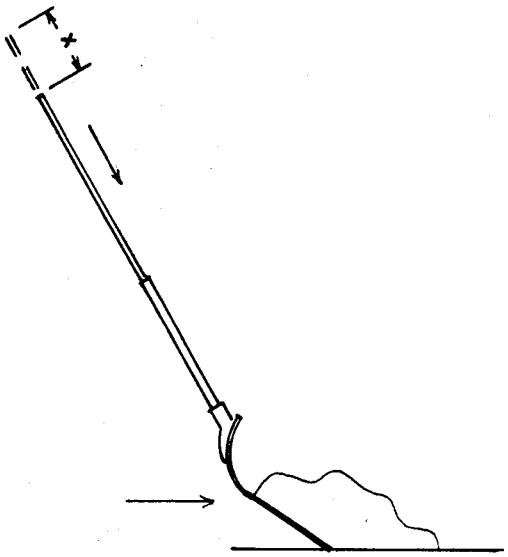
FIG. 2 shows a side view of the shovel as its spring is compressed by snow resistance from the forward movement of the shovel.
Figure 3:
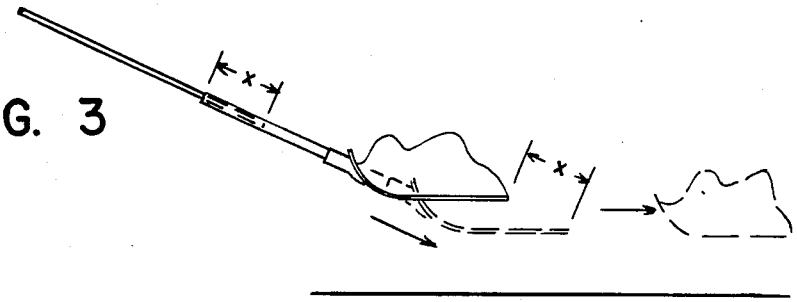
FIG. 3 shows the shovel under load ready for discharge.

In operation (see FIGS. 2 and 3) the handle is grasped by the user on its upper part and pushed against a load of snow. The pushing action will drive the upper handle part along the boss in the groove and compress the spring as the snow load gathers on the blade and the spring will remain in compression under such load. If an object submerged in the snow is struck the spring will be urged into further compression and will absorb the shock of the strike. When the shovel is raised and the load is directed away from the area of loading, the spring expands driving the lower handle part forward which assists in the discharge of the snow away.

What is claimed is:

1. A snow shovel comprised of a handle and a shovel blade attached at one end of the handle the handle comprising a pair of elongated telescoping tubular members configured and dimensioned to mate in intimate axial sliding relationship one to another;

an elongated compression spring contained within the tubular members having a first end secured to one of the pair of telescoping tubular members and a second end secured to the other of the pair of tubular members;

whereby, when an axial force is applied in the direction of the blade to the tubular member that is remote from the blade, the tubular members will telescope with respect to each other against the bias of the compression spring and, conversely, when the axial force is relieved, relaxation of the compression spring urges the tubular members toward an extended position.

2. A snow shovel as in claim 1 in which the blade is detachable for storage.

* * * * *